United States Patent [19]

Deutchman

[11] Patent Number: 4,504,988

[45] Date of Patent: Mar. 19, 1985

[54] PATIENT TRANSFER ARRANGEMENT

[76] Inventor: Gary Deutchman, Marietta, Ga.

[21] Appl. No.: 508,013

[22] Filed: Jun. 27, 1983

[51] Int. Cl.[3] ..... A61G 7/10

[52] U.S. Cl. ..... 5/81 R; 269/325; 297/DIG. 4; 414/921

[58] Field of Search ..... 5/81 R, 81 B, 86, 83; 297/DIG. 4; 269/325; 414/921

[56] References Cited

U.S. PATENT DOCUMENTS

| | | | |
|---|---|---|---|
| 3,041,636 | 7/1962 | Twedt | 5/81 R |
| 4,054,319 | 10/1977 | Fogg et al. | 297/DIG. 4 |
| 4,085,472 | 4/1978 | Di Mateo | 5/81 R |
| 4,119,342 | 10/1978 | Jones | 5/81 R |
| 4,192,549 | 3/1980 | Petersen | 297/DIG. 4 |
| 4,240,169 | 12/1980 | Roos | 5/81 R |

*Primary Examiner*—Alexander Grosz
*Attorney, Agent, or Firm*—Lieberman, Rudolph & Nowak

[57] ABSTRACT

An arrangement for transferring a patient between a wheelchair and an examination table. While the patient is in the seated position, segments of the examination table are arranged in front of the upper body of the patient, above the thighs of the patient, and in front of the lower legs of the patient. The examination table segments, in this configuration, are then moved simultaneously with the wheelchair until the patient is deposited onto the segments. The segments are then arranged in a desired configuration. The process is reversed for placing the patient back on the wheelchair.

18 Claims, 4 Drawing Figures

PATIENT TRANSFER ARRANGEMENT

BACKGROUND OF THE INVENTION

This invention relates generally to arrangements for examining invalid patients, and more particularly, to an arrangement whereby a patient in a sitting position on a wheelchair is transferred to a prone position on an examination table.

It is well known in the medical arts that an immobile, invalid patient is more difficult to transfer between a wheelchair and an examination table, than a patient who can provide even modest assistance. Such disabled patients include victims of injuries, disabling diseases, and the aged. Of course, these difficulties are particularly acute in the handling of large and obese patients. Ordinarily, several nurses or assistants are required to assist in the transference of an invalid patient so that torsion and stress to the patient's body are minimized.

Of course, once the patient has been deposited on the examination table, the arrangement of the patient into desired positions is facilitated by a variety of well-known mechanisms, including segmented examination tables wherein each segment is individually adjustable and powered. One such examination table is described in U.S. Pat. No. 3,281,141 to Smiley, et al. The examination table described in this reference is of the surgical type and is provided with a plurality of segments and a control panel which permits an operator to arrange the individual segments into a desired configuration which facilitates the examination, or surgery. A further such table is described in U.S. Pat. No. 3,113,770 to Rutledge. The examination table described in this reference is of the type used in chiropractic practice and, therefore, can be tilted in its entirety so as to permit the patient to be placed in a generally standing position, or in an upside down position for increasing circulation, and then lowered into a horizontal position. Such a tilting table, however, does not provide a solution to the problem of initially depositing an invalid patient onto the examination table.

One advantageous mechanism for transferring a patient to and from a horizontal structure, such as an examination table or a bed, is described in U.S. Pat. No. 3,041,636 to Twedt. The arrangement described in this reference permits an operator to transport a patient who is already sitting at the edge of the horizontal structure. This arrangement, however, relies upon the manual lifting of the patient onto the sitting position and the manual lifting of the patient to the transporting device by the application of a force thereto. Clearly, if the patient is an invalid or otherwise incapable of maintaining himself seated upright, at least one other assistant will be required to assist in the transference.

It is, therefore, an object of this invention to provide an arrangement whereby a patient can be transferred by only one person, irrespective of the size or weight of the patient.

It is also an object of this invention to provide an arrangement for transferring a patient onto an examination table in a face-down position without requiring that the patient be turned over manually.

It is yet a further object of this invention to provide an arrangement whereby a patient can be transferred from a sitting position to a prone position over an extended period of time.

SUMMARY OF THE INVENTION

The foregoing and other objects are achieved by this invention which provides an arrangement for transferring a patient between seated and substantially prone positions, the seated patient being supported by a wheelchair, and when the patient is in the prone position, the patient is supported by an examination table. In accordance with the invention, the arrangement is provided with a chair base onto which is rolled the wheelchair and affixed thereto. The examination table is of the segmented type and is provided with at least three segments. An uppermost segment is arranged in front of the upper body of the patient, and therefore, substantially parallel to the back of the wheelchair. In a preferred embodiment which is useful in chiropractic practice, the uppermost segment can be divided into a torso segment and a head segment, which may be movably coupled to one another. A second segment of the segmented examination table is arranged over the thighs of the patient, and therefore, substantially parallel to the seat of the wheelchair, and a third segment of the examination table is placed in front of the legs of the patient, and therefore, substantially parallel to a leg portion of the wheelchair. As the wheelchair is tilted forward by actuation of a tilting mechanism in the base, the segments of the examination table are also moved in such a way that the distances between the various segments and respective portions of the wheelchair remain substantially fixed.

Once the weight of the patient has been transferred such that the patient rests essentially on the segments of the examination table, the forward tilting of the wheelchair may be discontinued, and, if desired, the wheelchair can be returned to its upright position. The various segments of the examination table are then arranged so as to form a substantially planar surface. Thus, the patient has been transferred from a sitting position in a wheelchair to a substantially prone position on a substantially horizontal examination table, and only one operator need be present to operate the mechanism.

In one embodiment of the invention, locking means are provided for removably securing the wheels of the wheelchair to the tilting base such that the wheelchair will not roll off of the base as it is tilted forward or backward. The tilting base is provided with at least one actuator for moving the tilting base about a predetermined center of motion such that the wheelchair is moved arcuately about the center of motion. In a further embodiment, the tilting base may be provided with further actuators for moving the center of motion to a predetermined proximity with respect to the examination table. Moreover, a further actuator may be provided for raising and lowering the tilting base, and therefore, the wheelchair.

In one specific illustrative embodiment of the invention, the third segment of the examination table which is arranged to support the legs of the patient is pivotally coupled to a base member of the examination table. This third segment is also coupled pivotally to a thigh segment which supports the thighs of the patient. In such a particular embodiment, an actuator which may be a hydraulic or electromechanical servo is coupled at one end to the leg segment of the examination table and the thigh segment, at respective ends thereof.

In a further embodiment, the thigh segment of the examination table is pivotally coupled to the first segment, which communicates with the upper body of the patient. A second actuator is coupled at respective ends to the first segment and the thigh segment. Persons skilled in the art would recognize that the first segment which communicates with the upper body of the patient can be divided into a torso segment and a head segment which may be advantageously adjustable with respect to one another in a conventional manner.

In accordance with a method aspect of the invention, the three segments of the examination table are arranged in a predetermined transfer configuration such that the segments of the segmented examination table are arranged substantially parallel to respective portions of the wheelchair at respective predetermined distances therefrom; the patient being interposed there between. The wheelchair is then tilted forward by a predetermined center of pivot, and the three segments, about the predetermined transfer configuration, are moved simultaneously with the tilted wheelchair. In this manner, the distance between the segmented examination table and the wheelchair remains essentially constant during the transfer until the weight of the patient is borne almost entirely by the various segments of the examination table. Once the patient has been deposited securely onto the examination table, the segments are rearranged into a selected orientation with respect to one another, illustratively in a planar arrangement.

After the examination, or treatment, of the patient has been completed, and while the patient lies face down on the examination table, the segment of the examination table, which is in communication with the upper body of the patient, is raised above the segment which is in communication with the legs of the patient. In this manner, the patient is arranged in what appears as a seated-prone position, and then the wheelchair is tilted forward so as to overlie the back side of the patient. The wheelchair and the segments, which are therefore, once again in the transfer configuration, are moved arcuately rearward simultaneously until the patient is seated upright in the wheelchair once again. Such placement of the patient on the examination table, and his removal therefrom, is achievable in a simple manner without the need for a plurality of assistants, and without requiring rotation of the patient by the application of a potentially injurious torsion.

It is another advantage of this invention that the mechanism whereby the patient is transferred from the seated-prone position to the prone position, and from the prone position to the seated-prone position, can be achieved at selectable rates, including rates which are much slower than can be achieved by manual methods, thereby minimizing trauma to the patient and affording the patient time to complain of pain before damage is done.

DETAILED DESCRIPTION OF THE DRAWING

Comprehension of the invention is facilitated by reading the following detailed description in conjunction with the annexed drawings, in which.

DETAILED DESCRIPTION

Figure 1:
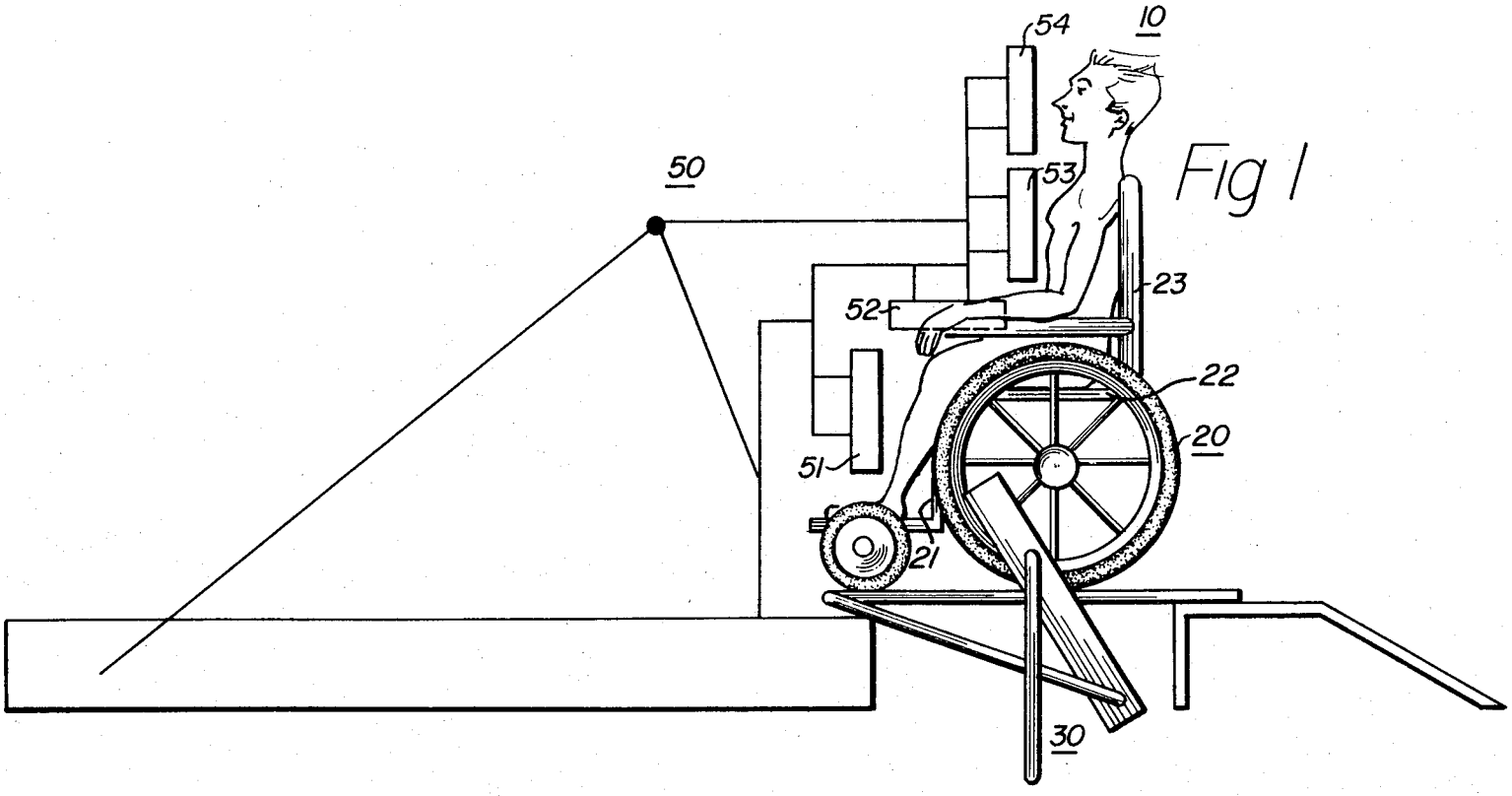
FIG. 1 is a highly schematic, side view of a patient seated on a wheelchair with the various segments of the examination table arranged in a transfer configuration.

FIG. 1 is a highly schematic representation of a patient 10 seated upright in a wheelchair 20 which is affixed on a tilting base 30. Patient 10 is to be deposited on an examination table 50 having a plurality of individual segments. In this embodiment, a lower leg segment 51 is arranged immediately in front of the legs of patient 10 and therefore substantially parallel to a leg portion 21 of wheelchair 20. A thigh segment 52 of examination table 50 is arranged immediately over the thighs of patient 10, and therefore is essentially parallel to seat portion 22 of wheelchair 20. A torso segment 53 is arranged immediately in front of patient 10, and therefore is essentially parallel to back portion 23 of wheelchair 20.

In this specific illustrative embodiment, examination table 50 is provided with a head segment 54 which is arranged in front of the head of patient 10. In some embodiments, however, head segment 54 may be incorporated into torso segment 53.

Figure 2:
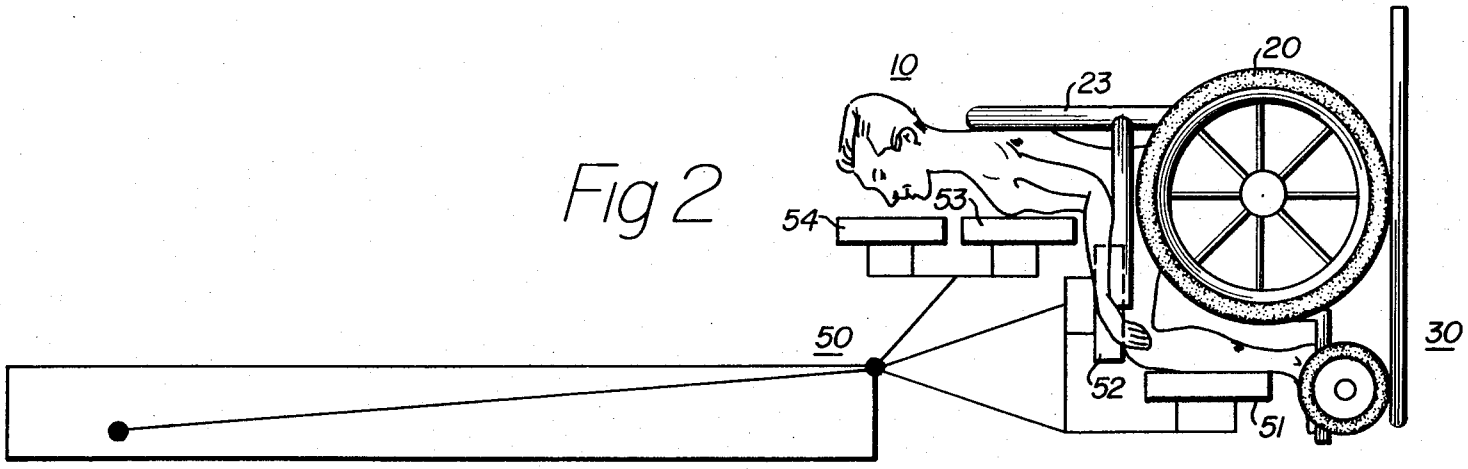
FIG. 2 is a highly schematic simplified view of the arrangement of FIG. 1 after forward tilting.

FIG. 2 is a highly schematic representation of the embodiment of FIG. 1 after wheelchair 20 and examination table 50 have been tilted forward simultaneously such that the weight of patient 10 is borne by segments 51, 52, 53 and 54. Tilting base 30 is shown tilted in this schematic illustration and, therefore, wheelchair 20 is also tilted forward.

Figure 3:
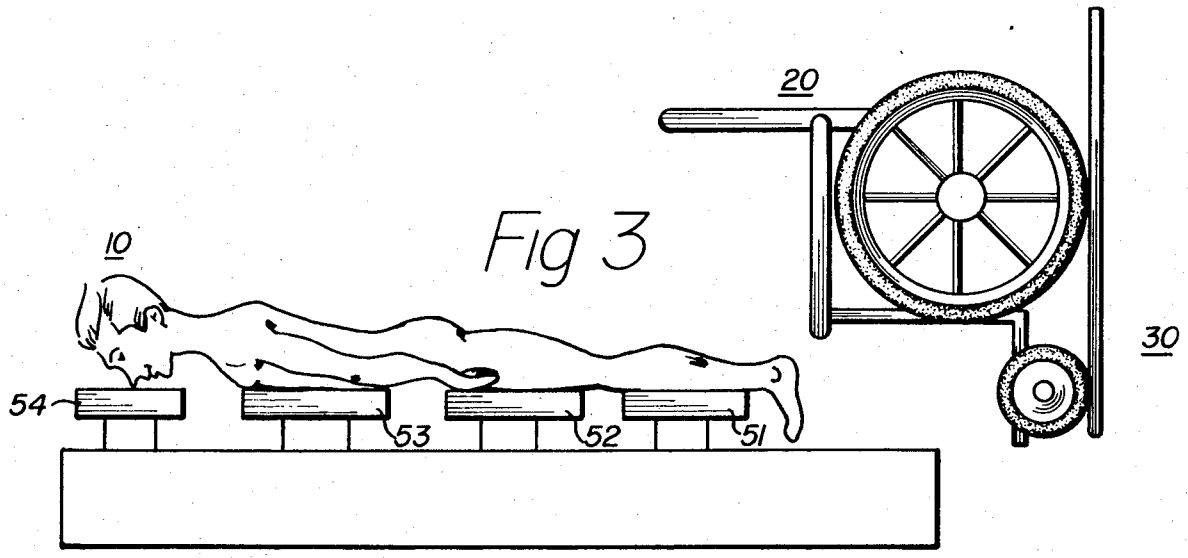
FIG. 3 is a highly schematic simplified side view of the arrangement after the segments have been reconfigured into a planar arrangement.

FIG. 3 is a highly schematic illustration of the embodiments of FIGS. 1 and 2 wherein the patient has been transferred to the examination table and segments 51, 52, 53 and 54 have been arranged to form a substantially planar surface. Of course, in certain embodiments, mechanism (not shown) may be provided for achieving any other desired examination configuration of the segments of examination table 50. Wheelchair 20 and examination table 50 are shown to be displaced laterally away from one another, by mechanism which will be desscribed hereinbelow.

Figure 4:
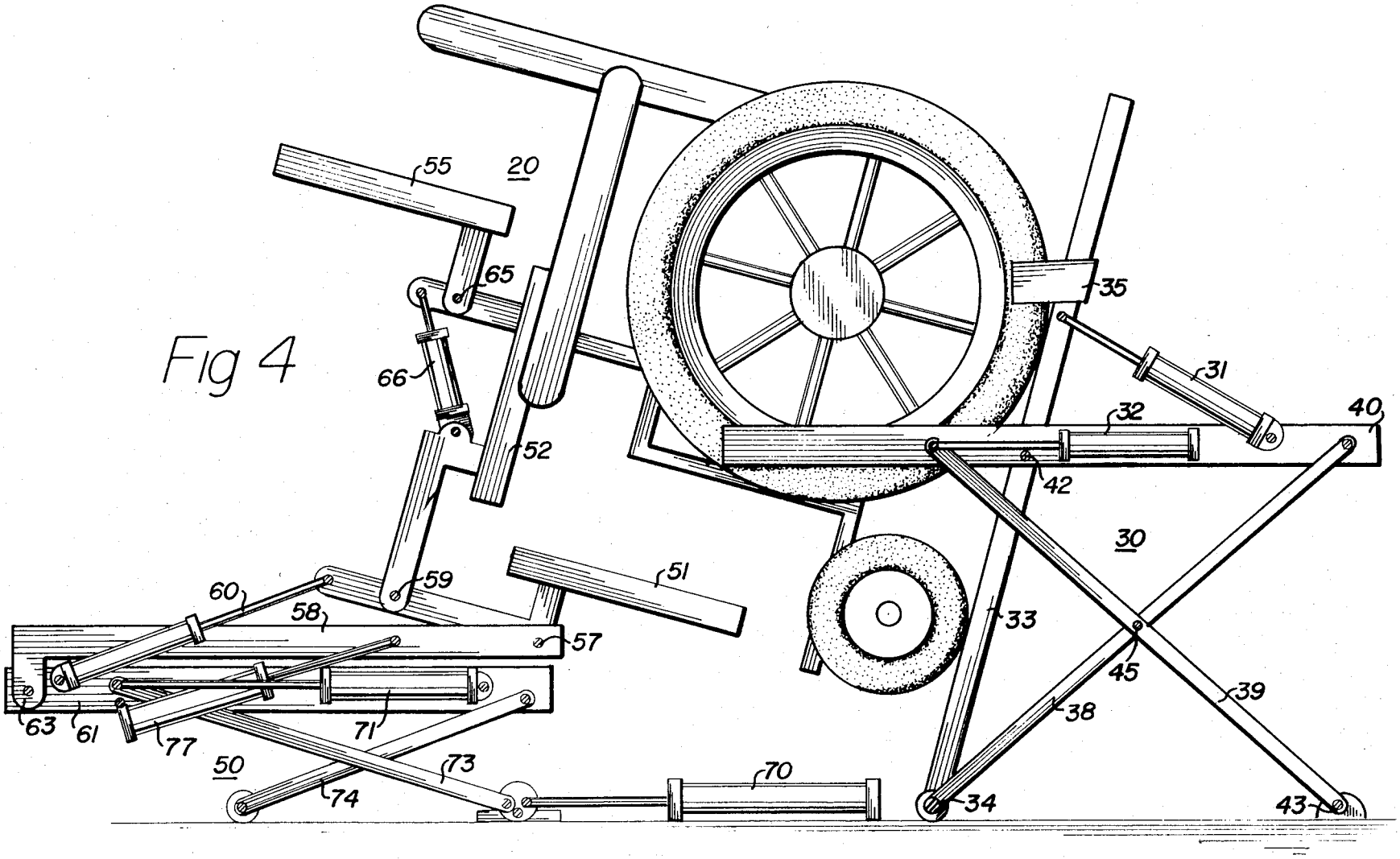
FIG. 4 is a schematic representation of the mechanism of the invention midway in the transferrance process.

FIG. 4 is a schematic illustration of an embodiment of the invention shown in a partially inclined position. In this embodiment, wheelchair 20 is shown to be arranged on tilting base 30 which is in the process of tilting. Tilting base 30, in this embodiment, is provided with a pair of actuators 31 and 32, which may be either hydraulic or electromechanical actuators, for tilting a support member 33 to which the wheelchair is removably secured via a locking mechanism 35 as shown schematically in this illustration. Tilting base 30 pivots about a center of pivot motion 34 which can be moved laterally.

Wheelchair 20 is, as indicated, coupled to support member 33, which support member is pivotally coupled to a cross member 38 at a pivot coupling at center of pivot motion 34. Cross member 38 is also pivotally coupled to a further cross member 39 at a scissor pivot 45, and to a frame member 40. Cross member 38 and 39 cooperate with each other in scissor-like motion to effect the pivotal motion of support member 33 and the subsequent tilting of wheelchair 20.

In operation, the actuation of actuators 31 and 32 cause frame member 40 to be responsively lowered or raised. As frame member 40 is lowered, for example, center of pivot motion 34 is translated laterally toward examination table 50, while a pivot coupling 43, which is in a fixed location, allows cross member 39 to move downward arcuately. Simultaneously, support member 33 also moves downward arcuately about center of pivot motion 34 so that it assumes a substantially horizontal orientation, and therefore the wheelchair is moved to an upright position. Conversely, as actuator 31 is extended and actuator 32 is withdrawn, frame member 40 is raised and support member 33 is moved toward the vertical position, thereby causing forward tilting of wheelchair 20. Center of pivot motion 34 moves laterally away from examination table 50. Of course, any of several other known mechanisms may be devised by persons skilled in the art to effect the requisite motion without exceeding the scope of the claimed invention.

In this embodiment, examination table 50 is provided with lower leg segment 51 and thigh segment 52, as described hereinabove. However, torso segment 53 and head segment 54 are combined into an upper body segment 55 which supports both the torso and the head of the patient (not shown in this illustration). In chiropractic table embodiments of the invention however, four segments may be used, as noted hereinabove.

Lower leg segment 51 is pivotally coupled at a pivot coupling 57 to a base member 58. The lower leg segment is further coupled at a coupling 59 to thigh segment 52. An actuator 60 is coupled at one end to thigh segment 52, and at another end to a sub-base member 61. Base member 58 and sub-base member 61 are pivotally coupled to one another, in this embodiment, at a pivot coupling 63. As shown, actuator 60 rotates thigh portion 52 clockwise until it is substantially orthogonal to lower leg portion 51.

Thigh segment 52 is pivotally coupled to upper body segment 55 at a pivot coupling 65. Moreover, an actuator 66 is pivotally coupled at respective ends thereof to thigh segment 52 and upper body segment 55. Actuation of actuator 66 causes upper body segment 55 to assume an orientation which is substantially orthogonal with respect to thigh segment 52.

Examination table 50 is movable laterally so as to assume a predetermined proximity with respect to wheelchair 20 by actuation of an actuator 70. In practice, the actual distance between the various segments of examination table 50 and wheelchair 20 will depend upon the size of the patient.

In accordance with a further aspect of the invention, the height of examination table 50 can be adjusted by actuation of an actuator 71 which is coupled at one end thereof to sub-base member 61, and at another end thereof to an articulated arm 73. Articulated arm 73 cooperates with a further articulated arm 74 such that the scissor action therebetween raises the entire examination table. In addition, a further actuator 77 which is coupled at one end to sub-base 61 and at another end to base member 58 permits base member 58 to be tilted upward so as to pivot about pivot coupling 63. In this manner, the prone patient can be inclined by raising the legs above the head and thereby relieving pressure in the spine. Such inclination is useful in chiropractic practice.

Although the invention has been described in terms of specific embodiments and applications, persons skilled in the art, in light of this teaching, can generate additional embodiments without departing from the spirit or exceeding the scope of the claimed invention. Accordingly, it is to be understood that the drawings and descriptions in this disclosure are proferred to facilitate comprehension and should not be construed to limit the scope thereof.

What is claimed is:

1. A patient transfer arrangement for transferring a patient between seated and substantially prone positions, the patient transfer arrangement comprising: a chair having a back member, a seat member, and a leg member; a segmented table having a base member, an upper body segment, a thigh segment, and a lower leg segment;

chair base means for supporting the chair secured thereto and moving the chair between upright and forwardly inclined positions; and segment drive means for moving the upper body, thigh and lower leg segments of the segmented table whereby, during the motion of the chair between said upright and said substantially inclined position, the upper body segment, the thigh segment, and the lower leg segment maintains substantially parallel spatial relationships with the back member, the seat member, and the leg member of the chair, respectively;

2. The patient transfer arrangement of claim 1 wherein the chair is a wheelchair having a plurality of wheels and there is further provided wheel locking means for removably securing said wheels to said chair base means.

3. The patient transfer arrangement of claim 1 wherein there is further provided chair base rotator means for moving said chair base means whereby the chair is moved arcuately about a predetermined center of motion.

4. The patient transfer arrangement of claim 3 wherein there is further provided chair base translator means for moving said predetermined center of motion laterally.

5. The patient transfer arrangement of claim 4 wherein there is further provided chair base elevator means for raising and lowering said chair base means, said chair base elevator cooperating with said chair base translator means.

6. The patient transfer arrangement of claim 1 wherein there are further provided first and second pivotal coupling means for coupling the lower leg segment to the base member and to the thigh segment, respectively.

7. The patient transfer arrangement of claim 6 wherein there is further provided first table actuator means having first and second end portions separated by a selectably adjustable distance, said first end portion being pivotally coupled to the base member, and said second end portion being pivotally coupled to the thigh segment.

8. The patient transfer arrangement of claim 7 wherein there is further provided third pivotal coupling means for coupling the thigh segment to the upper body segment.

9. The patient transfer arrangement of claim 8 wherein there is further provided second table actuator means having first and second end portions separated by a selectably adjustable distance, said first end portion being pivotally coupled to the thigh segment, and said second end portion being pivotally coupled to the upper body segment.

10. The patient transfer arrangement of claim 8 wherein the upper body segment is divided into a torso segment and a head segment, said torso segment being pivotally coupled to the thigh segment by said third pivotal coupling means,and arranged intermediate of the thigh segment and said head segment.

11. The patient transfer arrangement of claim 1 wherein there is further provided segmented table displacement means for moving the segmented table to a selectable proximity with respect to the chair.

12. The patient transfer arrangement of claim 1 wherein there is further provided segmented table elevator means for raising and lowering the base member of the segmented table.

13. The patient transfer arrangement of claim 1 wherein there is further provided segmented table tilt means for tilting the base member of the segmented table whereby, when the patient is in the substantially prone position the lower leg segment is selectably raised above the upper body segment.

14. A method for transferring a patient between a sitting position on a wheelchair and a substantially prone position on a segmented examination table having at least three segments, the method comprising the steps of:

arranging the three segments of the segmented examination table in a predetermined transfer configuration whereby each segment is disposed substantially parallel to a selective respective portion of the wheelchair at a respective predetermined distance therefrom, whereby the patient is intermediate of the wheelchair and the three segments of the examination table;

tilting the wheelchair forward about a predeterminable center of pivot; and moving the three segments of the examination table while in said predetermined transfer configuration simultaneously with the said step of tilting the wheelchair whereby said respective predetermined distances are maintained substantially constant as the wheelchair is tilted forward.

15. The method of claim 14 wherein there is further provided the step of rearranging the three segments of the segmented examination table to a selected orientation with respect to each other after the weight of the patient has been at least partially transferred thereto.

16. The method of claim 14 wherein, prior to said step of tilting, there is provided the further step of securing the wheelchair to a tilt table which is coupled to said center of pivot.

17. The method of claim 15 wherein, after the examination of the patient has been completed, there is provided the further step of raising a segment of the examination table which is in communication with an upper body portion of the patient above another segment of the examination table which is in communication with a leg portion of the patient.

18. The method of claim 17 wherein there is further provided the step of tilting the wheelchair forward about a predeterminable center of pivot whereby selected portions of the wheelchair are substantially parallel to respective segments of the examination table with the patient therebetween;

rearwardly tilting the wheelchair about said predetermined center of pivot;

moving the three segments of the examination table while in said predetermined transfer configuration simultaneously with said step of rearwardly tilting the wheelchair whereby said respective predetermined distances are maintained substantially constant as the wheelchair is tilted rearwardly.

* * * * *